US007066837B2

(12) United States Patent
Jordan

(10) Patent No.: US 7,066,837 B2
(45) Date of Patent: Jun. 27, 2006

(54) LOW SPIN, SOFT COMPRESSION, PERFORMANCE GOLF BALL

(75) Inventor: Michael D. Jordan, East Greenwich, RI (US)

(73) Assignee: Acushnet Company, Fairhaven, MA (US)

( * ) Notice: Subject to any disclaimer, the term of this patent is extended or adjusted under 35 U.S.C. 154(b) by 487 days.

(21) Appl. No.: 10/657,021

(22) Filed: Sep. 5, 2003

(65) Prior Publication Data

US 2004/0048687 A1 Mar. 11, 2004

Related U.S. Application Data

(63) Continuation of application No. 09/992,448, filed on Nov. 16, 2001.

(51) Int. Cl.
*A63B 37/06* (2006.01)

(52) U.S. Cl. ..... 473/374

(58) Field of Classification Search ..... 473/367, 473/368, 370, 371, 372, 373, 374, 377
See application file for complete search history.

(56) References Cited

U.S. PATENT DOCUMENTS

| | | | | |
|---|---|---|---|---|
| 3,262,272 A | | 7/1966 | Barakauskas et al. | |
| 4,431,193 A | | 2/1984 | Nesbitt | 273/235 R |
| 4,625,964 A | | 12/1986 | Yamada | 273/62 |
| 4,683,257 A | | 7/1987 | Kakiuchi et al. | 524/432 |
| 4,848,770 A | | 7/1989 | Shama | 273/228 |
| 4,919,434 A | | 4/1990 | Saito | 273/235 |
| 4,955,613 A | | 9/1990 | Gendreau et al. | 473/372 |
| 5,002,281 A | | 3/1991 | Nakahara et al. | 273/220 |
| 5,072,944 A | | 12/1991 | Nakahara et al. | 273/220 |
| 5,252,652 A | * | 10/1993 | Egashira et al. | 524/392 |
| 5,253,871 A | | 10/1993 | Viollaz | 273/228 |
| 5,314,187 A | | 5/1994 | Proudfit | 273/235 R |
| 5,334,673 A | | 8/1994 | Wu | 273/235 R |
| 5,692,974 A | | 12/1997 | Wu et al. | 473/377 |
| 5,711,723 A | * | 1/1998 | Hiraoka et al. | 473/374 |
| 5,776,012 A | | 7/1998 | Moriyama et al. | 473/372 |
| 5,779,563 A | | 7/1998 | Yamagishi et al. | 473/371 |
| 5,885,172 A | | 3/1999 | Hebert et al. | 473/354 |
| 5,897,884 A | | 4/1999 | Calabria et al. | 425/116 |
| 5,929,171 A | | 7/1999 | Sano et al. | 525/261 |
| 6,197,884 B1 | | 3/2001 | Rajagopalan et al. | 525/221 |
| 6,267,694 B1 | | 7/2001 | Higuchi et al. | 473/374 |
| 6,277,920 B1 | | 8/2001 | Nesbitt | 525/274 |
| 6,319,153 B1 | | 11/2001 | Nesbitt et al. | 473/377 |
| 6,394,913 B1 | * | 5/2002 | Nesbitt et al. | 473/371 |
| 6,602,941 B1 | * | 8/2003 | Higuchi et al. | 524/432 |

FOREIGN PATENT DOCUMENTS

| | | |
|---|---|---|
| GB | 2278609 A | 7/1994 |
| GB | 2291811 A | 4/1996 |
| GB | 2291812 A | 7/1996 |
| WO | WO 00/23519 | 4/2000 |
| WO | WO 01/19129 | 4/2001 |

* cited by examiner

*Primary Examiner*—Raeann Gorden
(74) *Attorney, Agent, or Firm*—William B. Lacy

(57) ABSTRACT

A golf ball including a core formed from a polybutadiene having Mooney viscosity of about 40 to about 65 and a salt of a halogenated thiophenol, and having a compression of about 30 to about 60; a first cover layer including a highly neutralized ethylene copolymer having a Shore D hardness of less than about 65; and a second cover layer including a thermoset or thermoplastic polyurethane having a Shore D hardness of about 40 to about 55.

13 Claims, 1 Drawing Sheet

LOW SPIN, SOFT COMPRESSION, PERFORMANCE GOLF BALL

This is a continuation of application Ser. No. 09/992,448, filed Nov. 16, 2001, now abandoned.

FIELD OF THE INVENTION

The present invention relates to a novel structure for golf ball, and more particularly to a progressive golf ball, which exhibits low spin when struck by a driver and high spin when struck by a wedge.

BACKGROUND OF THE INVENTION

Solid or non-wound golf balls are generally divided into two piece balls and multilayer or three piece balls. Two piece balls are generally more popular with the recreational golfer because they provide a very durable ball while providing maximum distance. Two piece balls are typically made with a single solid core, usually formed of a crosslinked rubber, which is encased by a cover material. The solid core is typically made from polybutadiene, which is chemically crosslinked with zinc diacrylate and/or similar crosslinking agents. The resiliency of cores can be improved by increasing the cross-link density. As the cross-linking increases, however, the compression also increases making the cores harder, which is undesirable. The cover tupically comprises tough, cut-proof blends of one or more ionomers such as SURLYN®, which are resins sold commercially by DuPont or IOTEK®, which is sold commercially by Exxon.

The combination of the above-described core and cover materials provides a "hard" ball that is resistant to cutting and other damages caused by repeatedly striking the ball with a golf club. Further, such a combination imparts a high initial velocity to the ball, which results in increased distance. Due to their hardness, however, these balls have a relatively low spin rate which makes them difficult to control, particularly on shorter approach shots. As such, these types of two piece balls are generally considered to be "distance" balls, but are hard when struck with a club.

Softer cover materials such as balata and softer ionomers in some instances, have been employed in two-piece construction balls in order to provide softer balls and increased back spin rates. With softer cover materials a more skilled golfer can impart back spin on the ball that will make the ball stop once it strikes the landing surface instead of bouncing forward. The ability to impart back spin onto a golf ball is related to the degree that the golf ball cover deforms when it is struck with a golf club. Regardless of the form of the ball, players generally seek a golf ball that delivers maximum distance, which requires a high initial velocity upon impact. Therefore, in an effort to meet the demands of the marketplace, manufacturers strive to produce golf balls having initial velocities as close to, but still within, the maximum velocity allowed by the United States Golf Association ("USGA") test (250 ft/s±2.5% (5 ft/s)). Furthermore, golf ball manufacturers are also continually searching for new ways in which to provide golf balls that deliver the maximum performance in terms of both distance and spin rate for golfers of all skill levels.

Relatively recently, a number of golf ball manufacturers have introduced multilayer or three piece golf balls, i.e., balls with multiple core layers and/or multiple cover layers, in an effort to overcome some of the undesirable aspects of conventional two piece balls, such as hardness, while maintaining the positive attributes of these golf balls, such as high initial velocity and distance. Examples of such improved multiple layer balls include the Titleist® Pro-V1, among others.

Examples of multiple layer ball patents include U.S. Pat. No. 5,072,944, which discloses a three-piece solid golf ball having a center and outer layer, which are prepared from a rubber composition, preferably having a base polybutadiene rubber. This patent also discloses that it is desirable that the center core be softer than the outer layer, wherein the layers have a hardness of 25–50 Shore C and 70–90 Shore C respectively. U.S. Pat. No. 4,625,964 relates to a solid golf ball having a polybutadiene rubber core of a diameter not more than 32 mm, and a polybutadiene rubber intermediate layer having a specific gravity lower than that of the core material. U.S. Pat. No. 4,848,770 discloses a non-wound three-piece golf ball, which includes a core with a highly filled synthetic rubber or polymeric material, an intermediate layer of an unfilled synthetic rubber and a cover. The core and intermediate layer have a hardness between 50–95. U.S. Pat. No. 5,002,281 is directed towards a three-piece solid golf ball which has an inner core having a hardness of 25–70 Shore C and an outer shell having a hardness of 80–95 Shore C, wherein the specific gravity of the inner core must be greater than 1.0, but less than or equal to that of the outer shell, which must be less than 1.3. U.S. Pat. No. 5,253,871 concerns a golf ball having a three-piece structure comprising an elastomer core, an intermediate layer of a thermoplastic material containing at least 10% of ether block copolymer, preferably blended with an ionomer and a thermoplastic cover.

Several additional patents are more specifically directed to golf balls having multiple cover layers. For example, U.S. Pat. No. 4,431,193 relates to a golf ball having a multilayer cover, wherein the inner layer is a hard, high flexural modulus ionomer resin and the outer layer is a soft, low flexural modulus ionomer resin. Either or both layers may comprise a foamed ionomer resin. U.S. Pat. No. 5,314,187 also relates to golf balls having a cover formed with multiple layers, wherein the outer layer is molded over the inner layer and comprises a blend of balata and an elastomer and the inner layer is an ionomer resin. U.S. Pat. No. 4,919,434 is directed towards a golf ball having a cover, which comprises an inner layer and an outer layer, each of which comprises a thermoplastic resin. Preferably, the layers comprise materials that are capable of fusion bonding with each other. U.K. Patent Application Nos. GB 2,291,817 and 2,291,812 are both directed towards wound golf balls with improved distance comprising a dual cover layer, wherein the inner cover layer has a high hardness as compared to the outer cover layer. These references disclose that the cover layers may be formed from balata or ionomer resins and should have a combined thickness of less than 4 mm. U.K. Patent Application No. GB 2,278,609 discloses a multilayer cover comprising an inner cover layer of a high acid ionomer and an outer cover layer of a soft ionomer or a non-ionomeric thermoplastic elastomer.

Recently, U.S. Pat. No. 5,885,172 ("the '172 patent") advanced the multiple layer cover design with an inner cover layer made from a hard, high flexural modulus resilient material, e.g., ionomers or ionomer blends and an outer cover layer made from a thin soft thermoset castable reactive liquid material, e.g. thermoset polyurethanes or urethanes, among others. The '172 patent discloses that by creating a golf core and inner cover having a long distance, low spin construction, but adding a thin outer cover layer of a relatively soft thermoset material, the desired back spin for greenside play can be achieved in a distance ball.

There remains a need, however, for an overall soft performance ball that has a soft inner cover, which in combination with a soft, high velocity core produces long distances off of driver clubs, and which in combination with a soft thermoset outer cover also produces high spins off of wedge-type clubs.

SUMMARY OF THE INVENTION

The present invention is directed to a progressive performance golf ball comprising a core formed of polybutadiene with Mooney viscosity is in the range of about 40 to about 60, at least an inner cover layer, which is formed of an ionomer having a Shore D hardness on the ball of less than about 65, and an outer cover layer, which surrounds the first cover layer is formed of a polyurethane material having a Shore D hardness on the ball in the range of about 40 to about 55.

In accordance to another aspect of the invention, the core compression is less than 60, more preferably in the range of about 30 to about 60, and most preferably in the range of about 50 to about 55. The core may also comprise an organic sulfur to increase the resiliency and coefficient of restitution of the core and the ball. Preferred organic sulfurs include pentachlorothiophenol and a metal salt of pentachlorothiophenol.

The core can be a single layer or may comprise a plurality of layers. The innermost portion of the core may be solid or it may be a fluid-filled sphere. The inner cover layer can be made from high acid copolymer ionomers, very low modulus acid copolymer ionomers, low modulus acid copolymers (e.g., polyethylene methacrylic acid and acrylic acid such as NUCREL® available from DuPont) thermoplastic or thermoset polyurethanes, thermoplastic or thermoset polyetheresters or polyetheramides, thermoplastic or thermoset polyester, dynamically vulcanized elastomers, functionalized styrenebutadiene elastomers, metallocenes, highly neutralized ethylene copolymers, and highly resilient thermoplastic elastomeric compositions. The outer cover layer can be made from a thermoplastic or thermoset urethane or polyurethane.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
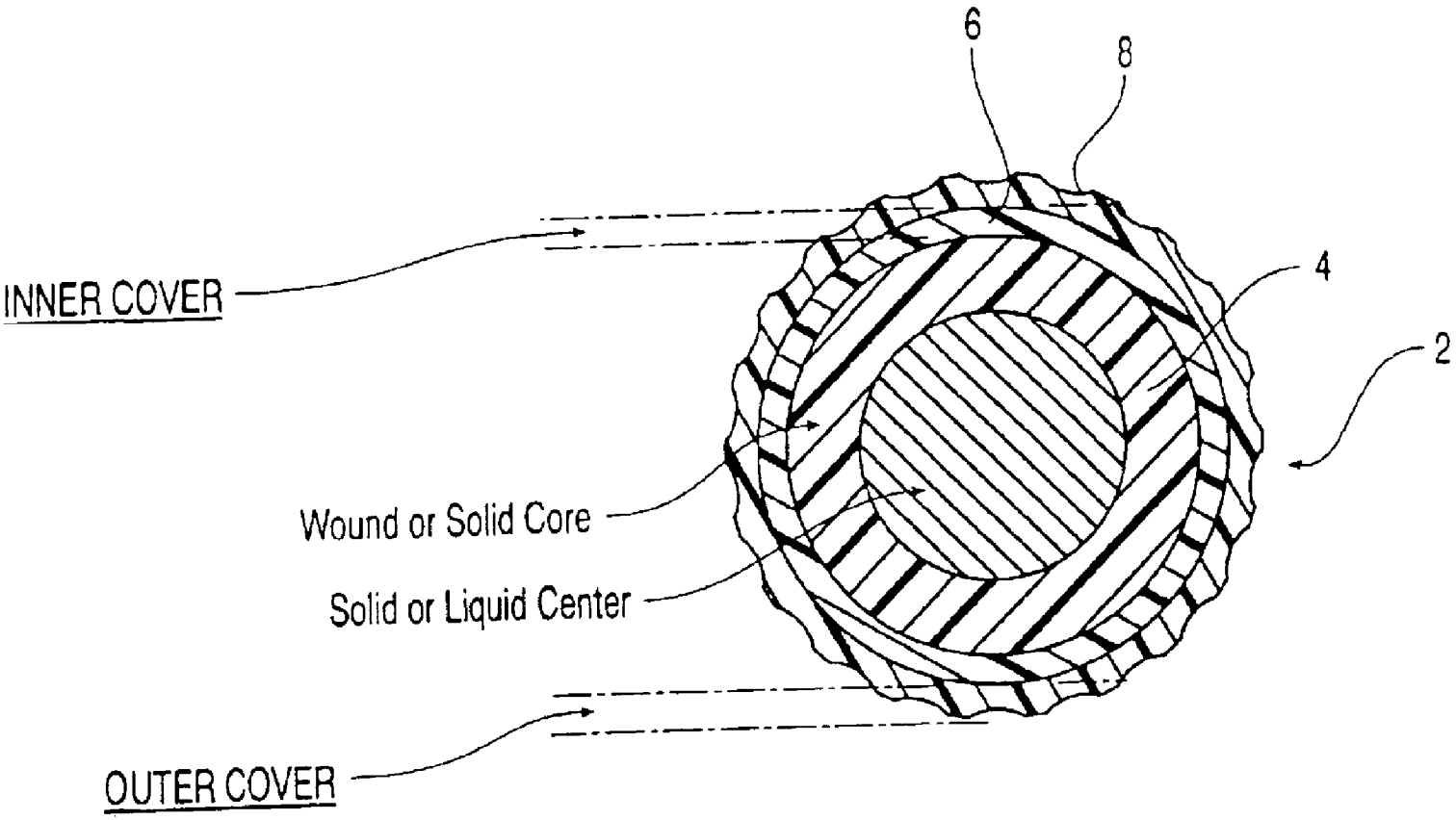
FIG. 1 is a cross-section view of a golf ball 2 having a core 4, which preferably is a solid core, an inner cover 6 and an outer cover 8.

The golf ball in accordance to the present invention has a "progressive performance" when struck with a variety of clubs. More specifically, as used herein, the term "progressive performance" means that the presently claimed golf ball has the distance benefits of a traditional hard covered two piece ball when struck at a high club head speed with a club having a low loft angle, but also the high spin and feel characteristics similar to that of a traditional soft covered wound ball when struck at a low club head speed with a club having a high loft angle. Thus, golf balls of the presently claimed construction provide the "best of both worlds" in the golf ball art, i.e., a maximum distance ball for long shots (e.g., with a driver) and high spin and controllability for short shots (e.g., with a wedge).

Without being limited to any particular theory, it is believed that at low club head speed and high loft shots such as those made with an 8-iron or a wedge, a ball's surface hardness has a greater influence on the ball's flight characteristics than the ball's overall construction. Thus, all other parameters being equal, a ball with a softer surface will have a higher spin rate than one with a harder surface. Conversely, however, when a golf ball is struck with a high club head speed and a low loft angle, such as that of a driver, it appears that the opposite is true and that the overall construction of the ball has greater influence on the ball's flight characteristics than does the surface hardness.

Thus, when a golf ball with a low spin construction is made with a relatively thin cover layer of a relatively soft thermoset material formed from a castable reactive liquid, a golf ball with "progressive performance" from driver to wedge can be formed. As used herein, the term "thermoset" material refers to an irreversible, solid polymer that is the product of the reaction of two or more prepolymer precursor materials.

Accordingly, by the present invention, when such a "progressive performance" ball is made with a soft but high velocity core and a soft inner cover layer, the resultant sub-assembly generates very low spin and long distance off of a driver with a lower hardness. Furthermore, when this "progressive performance" sub-assembly is also made with a soft outer cover layer, the soft inner cover layer and soft outer cover layer provide a softer surface for higher spin rate when struck by a wedge. In a preferred embodiment, the core is generally made with a polybutadiene ("PBD") material that possesses middle or higher value Mooney viscosity, which provides a soft but high velocity core. The core may also be blended with an organic sulfur plasticizer such as pentachlorothiophenol to further increase the softness and resiliency of the core. The inner cover layer is preferably a relatively soft ionomer material, which in addition to the contribution to the overall softness of the ball also provides a barrier to moisture vapor that tends to attack and degrade the PBD core. The outer core is preferably a thermoplastic or thermoset urethane material. This and other preferred embodiments are further described below.

With respect to the outer cover layer 8, the thickness of the outer cover layer is an important factor to the "progressive performance" of the golf balls. If the outer cover layer is too thick, this cover layer will contribute to the in-flight characteristics related to the overall construction of the ball and not the cover surface properties. However, if the outer cover layer is too thin, it will not be durable enough to withstand repeated impacts by the golfer's clubs. Specifically, it has been determined that the outer cover layer should have a thickness of between about 0.02 and about 0.05 inches and most preferably, this thickness is about 0.035 inches.

The outer cover layer 8 is preferably formed from a relatively soft thermoset material cast onto the inner cover layer 6 in order to replicate the soft and high spin play characteristics of a balata ball when the balls of the present invention are used for pitch and other "short game" shots. In particular, the outer cover layer should have a Shore D hardness of from about 40 to about 55, preferably from about 45 to about 48, and has a Shore D hardness on the ball of greater than about 53. Shore D hardness is preferably tested in accordance to ASTM D-2240-86 among others. Additionally, the materials of the outer cover layer must have a degree of abrasion resistance suitable for use as a golf ball cover.

The outer cover layer of the present invention can comprise any suitable thermoset material which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974 entitled "Golf Ball Covers," the disclosure of which is hereby incorporated by reference in its entirety in the present application. The outer cover layer can also be made with a thermoplastic urethane material, which preferably can be manufactured using a retractable pin injection molding technique.

More preferably, the outer cover material is made from a thermoset cast polyurethane, disclosed in U.S. Pat. No. 5,334,673, which is incorporated by reference herein in its entirety. Specifically, the more preferred polyurethane is a composition of polyurethane pre-polymer and a slow reacting polyamine curing agent and/or a difunctional glycol.

Thermoset polyurethane and urethane outer cover materials can be cast onto the inner cover layer using several casting methods. A known two-pack casting method, such as the one disclosed in U.S. Pat. No. 5,897,884, can be used. The '884 patent is hereby incorporated by reference in its entirety. Generally, in a two-pack casting method, the polyurethane material is formed by a reaction between polyurethane prepolymer and a curing agent. The polyurethane prepolymer itself is formed by a reaction between a polyol and a diisocyanate. A curing agent used is typically either a diamine or glycol. A catalyst may be employed to promote the reaction between the curing agent and the polyurethane prepolymer. The mixing and casting sequence and the timing are controlled as discussed in the '884 patent. Furthermore, the mixed materials have a relatively limited shelf life due to the reaction of the isocyanate group with the other components after mixing. Precisely measured ratio of the components is desirable, because off-ratio mixing yields less desirable components.

Conventionally, thermoset polyurethanes are prepared using a diisocyanate, such as 2,4-toluene diisocyanate ("TDI") or methylenebis-(4-cyclohexyl isocyanate) ("HMDI") and a polyol which is cured with a polyamine, such as methylenedianiline ("MDA"), or a trifunctional glycol, such as trimethylol propane, or tetrafunctional glycol, such as N,N,N',N'-tetra(2-hydroxpropyl) ethylenediamine. However, the present invention is not limited to just these specific types of thermoset polyurethanes. Quite to the contrary, any suitable thermoset polyurethane may be employed to form the outer cover layer of the present invention.

Alternatively, a simplified one-pack casting method can be used to make the outer cover or any castable component of the ball. This one-pack casting method is disclosed in co-pending U.S. application Ser. No. 09/973,342, filed on Oct. 9, 2001. The disclosure of this co-pending application is incorporated herein by reference.

According to this one-pack method, a blocked urethane moisture vapor barrier layer is cast onto a golf ball core. Preferably, uretdiones or blocked isocyanates are used to form a single-pack urethane component. The single-pack blocked isocyanate system, which preferably comprises isocyanate combined with an amine or poloyl, is advantageously stable at room temperature. The application of heat causes the isocyanate to become unblocked or to react to form a urethane. No mixing or dynamically controlling the ratios of the components is required.

Uretdione castable materials can be pre-formulated as a single-pack system without premature reaction. The mixed single-pack material can be directly injected or poured into a mold, avoiding metering and mixing of multiple components. Parts can be made utilizing viscous or solid materials that previously could not be used with traditional two-pack systems. Advantageously, uretdiones and blocked isocyanates when combined with suitable reactive components can be milled into rubber stock for use with other manufacturing techniques, discussed above.

Other suitable manufacturing methods include, but not limited to, pre-formed semi-cured half shells, sheet stock, spraying, dipping, injection molding, reaction injection molding, among others.

The inner cover layer 6 of the golf ball in accordance to the present invention preferably has a thickness in the range of about 0.02 inches to about 0.05 inches, and more preferably about 0.035 inches. A preferred inner cover material is a thermoplastic ionomer material, and more preferably sodium or zinc blended thermoplastic materials. Each of these preferred materials has a flexural modulus of less than 50,000 psi, and more preferably in the range of about 25,000 to 35,000 psi. Flexural modulus is preferably measured in accordance to ASTM 6272-98, and the test specimen should be conditioned for at least two weeks. Moreover, the Shore D hardness of the preferred inner cover material is less than about 65 on the ball and preferably in the range of about 60 to about 63. The inner cover layer preferably has no density filler and preferably has a specific gravity of about 0.95.

The manner in which the ionomers are made is well known in the art as described in, e.g., U.S. Pat. No. 3,262,272. Such ionomer resins are commercially available from DuPont under the tradename SURLYN® and from Exxon under the tradename IOTEK®. In accordance to one aspect of the invention, the inner cover material is made from high acid copolymer ionomers, wherein the copolymer contains at least about 16% acid by weight and about 10 to about 90% of the acid is neutralized with sodium, manganese, lithium, potassium, zinc, magnesium, calcium, or nickel ions. Examples of suitable high acid ionomers include SURLYN® 8140 (Na), SURLYN® 8546(Li), SURLYN® 8240 (Na) and SURLYN® 8220(Na). In accordance to another aspect of the invention, the inner cover material is made from "very low modulus acid copolymer ionomer" or ("VLMI"), wherein the copolymer contains about 10% by weight of acid and 10 to 90% of the acid is neutralized by sodium, zinc or lithium ions. The VLMI has a Shore D hardness off-the-ball of about 20 to about 50 and a flexural modulus of about 2,000 to 8,000 psi. Suitable VLMI's include SURLYN® 8320 (Na), SURLYN® 9320(Zn) and SURLYN® 8120(Na). These high acid copolymer ionomers and VLMIs are described in U.S. Pat. No. 6,197,884 ("the '884 patent"). The '884 patent is incorporated herein by reference in its entirety.

The materials for the inner cover layer, however, are not limited to ionomer resins. Instead, the present invention contemplates that virtually any soft, resilient material, which is compatible with the other materials of the golf ball may be employed as the inner cover layer. Examples of other suitable inner cover materials include thermoplastic or thermoset polyurethanes, thermoplastic or thermoset polyetheresters or polyetheramides, thermoplastic or thermoset polyester, a dynamically vulcanized elastomer, a functionalized styrenebutadiene elastomer, a metallocene polymer or blends thereof. The inner cover materials can also be made from highly neutralized ethylene copolymers, which are thermoplastics with high resilience, high CoR and are relatively soft (low compression as measured by the Atti machine). Such highly neutralized ethylene copolymers are disclosed in WO 01/29219. The inner cover materials can also be made with highly resilient thermoplastic elastomeric compositions, which comprises a thermoplastic polymer, a salt of high molecular weight organic acid, an acid containing copolymer ionomer and an optional filler. Such highly resilient thermoplastic elastomer compositions are disclosed in WO 00/23519. The disclosures of WO 01/29219 and WO 00/23519 are incorporated herein by reference in their entirety.

Other suitable inner cover materials include thermoplastic polyetheresters, which are commercially available from DuPont under the tradename HYTREL®, and thermoplastic polyetheramides, which are available from Elf-Atochem under the tradename PEBAX®. Additional suitable materials for the inner cover layer include nylon, acrylonitrile-butadiene-styrene copolymer (ABS) and metallocene polymers. The manufacturing methods for the outer cover layer described above are also applicable to the manufacture of the inner cover layer.

The golf ball cores of the present invention may comprise any of a variety of constructions. For example, the core of the golf ball may comprise a conventional center surrounded by an intermediate layer disposed between the center and the inner cover layer. The core may be a single layer or may comprise a plurality of layers. The innermost portion of the core may be solid or it may be a fluid-filled sphere. As with the core, the intermediate layer may also comprises a plurality of layers. The core may also comprise a solid or fluid-filled center around which many yards of a stretched elastic thread or yarn are wound.

A preferred embodiment of the core is a solid unitary core. The preferred compositions for the solid core include, but not limited to, a base rubber, a crosslinking agent, a filler, and a co-crosslinking or initiator agent. The base rubber typically includes natural or synthetic rubbers.

The core 4 of the golf ball of the present invention preferably has a diameter in the range of about 1.53 inches to about 1.58 inches, and more preferably about 1.55 inches. In accordance to one aspect of the present invention, the core is made from a polybutadiene rubber that has a mid viscosity range from about 40 to 60 Mooney viscosity. Polybutadiene rubber with higher Mooney viscosity may also be used, so long as the viscosity of the PBD does not reach a level where the high viscosity PBD clogs or otherwise adversely interferes with the manufacturing machinery. It is contemplated that PBD with viscosity less than 65 Mooney viscosity can be used with the present invention. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Golf ball cores made with mid to high Mooney viscosity PBD material exhibit increased resiliency, hence distance, without increasing the hardness of the ball. Such cores are soft, i.e., compression less than about 60 and more specifically in the range of about 50 to about 55, and when these soft cores are incorporated into golf balls such cores generate very low spin and long distance when struck by a driver. Cores with compression in the range of from about 30 about 50 are also within the range of the present invention. Compression is measured by applying a spring-loaded force to the golf ball center, golf ball core or the golf ball to be examined, with a manual instrument (an "Atti gauge") manufactured by the Atti Engineering company of Union City, N.J. This machine, equipped with a Federal Dial Gauge, Model D81-C, employs a calibrated spring under a known load. The sphere to be tested is forced a distance of 0.2 inch (5 mm) against this spring. If the spring, in turn, compresses 0.2 inches, the compression is rated at 100; if the spring compresses 0.1 inches, the compression value is rated as 0. Thus more compressible, softer materials will have lower Atti gauge values than harder, less compressible materials. Compression measured with this instrument had been referred in the art as PGA compression. The approximate relationship that exists between Atti compression and Riehle compression can be expressed as:

$$(\text{Atti compression})=(160-\text{Riehle Compression}).$$

Thus, a Riehle compression of 100 would be equated with an Atti compression of 60.

In accordance to another aspect of the invention, the addition of an organic sulfur compound to the core further increases the resiliency and the coefficient of restitution of the ball. Preferred organic sulfur compounds include, but not limited to, pentachlorothiophenol ("PCTP") and a salt of PCTP. A preferred salt of PCTP is ZnPCTP. The utilization of PCTP and ZnPCTP in golf ball cores to produce soft and fast cores is disclosed in co-pending U.S. application Ser. No. 09/951,963 filed on Sep. 13, 2001, and is assigned to the same assignee as the present invention. This co-pending application is incorporated by reference herein, in its entirety. A suitable PCTP is sold by the Struktol Company under the tradename A95. ZnPCTP is commercially available from EchinaChem.

Commercial sources of suitable mid to high Mooney viscosity PBD sold by Bayer AG include:

| PBD | Catalyst | Cis-1,4 content | Mooney viscosity (ML(1 + 4) 100° C.) |
|---|---|---|---|
| CB 10 | Cobalt | >96% | 47 |
| CB 10 LM | Cobalt | >96 | 43 |
| CB 22 | Neodymium | ~98% | 63 |
| CB 23 | Neodymium | ~98% | 51 |
| CB 24 | Neodymium | ~98% | 44 |
| CB 25 | Neodymium | ~98% | 44 |

CB 23, which has a Mooney viscosity of about 51 and is a highly linear polybutadiene, is a preferred PBD. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are based on 100 parts by weight of the total elastomer mixture.

Metal salt diacrylates, dimethacrylates, and monomethacrylates suitable for use in this invention include those wherein the metal is magnesium, calcium, zinc, aluminum, sodium, lithium or nickel. Zinc diacrylate ("ZDA") is preferred, but the present invention is not limited thereto. ZDA provides golf balls with a high initial velocity. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4–8% zinc stearate. Suitable, commercially available zinc diacrylates include those from Rockland React-Rite and Sartomer. The preferred concentrations of ZDA that can be used are about 25 pph to about 35 pph based upon 100 pph of polybutadiene or alternately, polybutadiene with a mixture of other elastomers that equal 100 pph. Advantageously, the PCTP organic sulfur reacts with the ZDA used in the core to further increase the initial velocity of golf balls.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at about 70% to about 100% activity are preferably added in an amount ranging between about 0.05 pph and about 2.5 pph based upon 100 parts of butadiene, or butadiene mixed with one or more other elastomers. More preferably, the amount of initiator added ranges between about 0.15 pph and about 2 pph and most preferably between about 0.25 pph and about 1.5 pph. Suitable commercially available dicumyl peroxides include PERKADOX® BC, which is a 90% active dicumyl peroxide, and DCP 70, which is a 70% active dicumyl peroxide.

Golf ball core also typically include about 5 to about 50 pph zinc oxide or 0.1 to 15 pph of calcium oxide in the ZDA-peroxide cure system that crosslinks the polybutadiene during the core molding process.

The center compositions of the present invention preferably include fillers, added to the elastomeric composition to adjust the density and/or specific gravity of the core. As used herein, the term "fillers" includes any compound or composition that can be used to vary the density and other properties of the subject golf ball core. Appropriate fillers preferably used range in specific gravity from about 2 to 19. Fillers useful in the golf ball core according to the present invention include, for example, metal (or metal alloy) powders, metal oxide, metal stearates, particulate, carbonaceous materials, and the like or blends thereof. The amount and type of filler utilized is governed by the amount and weight of other ingredients in the composition, since a maximum golf ball weight of 1.620 ounces has been established by the USGA.

Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulate carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled uncured center material mixed and ground to 30 mesh particle size), manganese powder, and magnesium powder.

Antioxidants may also be included in the elastomer centers produced according to the present invention. Antioxidants are compounds, which prevent the breakdown of the elastomer. Antioxidants useful in the present invention include, but are not limited to, quinoline type antioxidants, amine type antioxidants, and phenolic type antioxidants.

Other ingredients such as accelerators, e.g. tetra methylthiuram, processing aids, processing oils, dyes and pigments, as well as other additives well known to the skilled artisan may also be used in the present invention in amounts sufficient to achieve the purpose for which they are typically used.

The core 4 may be formed by mixing and forming the base composition using conventional techniques. More particularly, the core compositions of the invention are produced by forming a mixture comprising polybutadiene, zinc diacrylate, the plasticizer, if used, and filler. When a set of predetermined conditions is met, i.e., time and temperature of mixing, the free radical initiator is added. In particular, as the components are mixed, the resultant shear causes the temperature of the mixture to rise. After completion of the mixing, the golf ball core composition is milled and hand prepped or extruded using a machine into pieces ("preps") suitable for molding. The milled preps are then compression molded into cores at an elevated temperature, typically 320° F. for 15 minutes at 2,500 lbs of pressure. These centers can then be used to make finished golf balls by surrounding the centers with cover materials.

The following core samples were made in accordance to the invention:

| SAMPLE 1 | | SAMPLE 2 | | SAMPLE 3 | |
|---|---|---|---|---|---|
| Components | PHR | Components | PHR | Components | PHR |
| PBD CB 23 | 100 | PBD CB 23 | 100 | PBD CB 23 | 100 |
| PCTP organic sulfur on clay carrier | 1.75 | PCTP organic sulfur on clay carrier | 5.3 | Zinc salt of PCTP | 2.35 |
| ZDA | 30 | ZDA | 34 | ZDA | 28 |
| ZnO | 4.6 | ZnO | 5 | ZnO | 5 |
| Tungsten filler | 11.1 | Tungsten filler | 10.4 | Tungsten filler | 11.6 |
| 90% active dicumyl peroxide | 0.75 | 70% active dicumyl peroxide | 1.86 | 70% active dicumyl peroxide | 0.8 |

All three samples produce cores with the desired high CoR and low compression values. The CoR values range between about 0.795 to about 0.806 and can be as high as 0.815. Sample 3 produces the highest CoR value and is the most durable. Prototype balls with core Sample 3, a soft SURLYN® ionomer inner cover layer with a Shore D hardness of about 63 on the ball and a thermoset polyurethane outer cover layer with a Shore D hardness of about 45 off the ball were made. The hardness of the prototype ball is generally greater than about 53 Shore D and the compression on the prototype is generally between about 63 and about 66. The prototype ball's properties and performance characteristics are compared to the "progressive performance" Pro-V1 ball as follows:

| | Core | | Core & Inner Cover | | Ball | | |
|---|---|---|---|---|---|---|---|
| | Size | Compression | Size | Compression | Shore D | Compression | CoR |
| Pro V1 | 1.55 | 75 | 1.62 | 85 | 56 | 86 | 0.805 |
| Prototype | 1.55 | 53 | 1.62 | 63 | 54 | 66 | 0.806 |

The spin rates and distances traveled when the above balls are struck by the various golf clubs are as follows. In the table below, the ft/s values indicate the speed that the mechanical driver travels when it strikes the ball.

| | Spin (revolutions per minute) | | | | Distance (yards) | | | |
|---|---|---|---|---|---|---|---|---|
| | 160 ft/s Driver | 140 ft/s Driver | 8-Iron | Half Wedge | 175 ft/s Driver | 167 ft/s Driver | 160 ft/s Driver | 140 ft/s Driver |
| Pro V1 | 3064 | 3815 | 7621 | 6731 | 297.4 | 275.7 | 262.8 | 219.6 |
| Prototype | 2679 | 3369 | 6936 | 6325 | 297.7 | 276.2 | 265.6 | 224.7 |

As the data shows, the prototype golf ball made in accordance to the present invention exhibits spin rates comparable to, albeit lower than, the progressive performance Pro V1 ball. While due to its higher CoR and lower compression, the prototype golf ball displays slightly better distances from the driver clubs.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising:

a core comprising a polybutadiene having Mooney viscosity of about 40 to about 65 and a salt of a halogenated thiophenol, and having a compression of about 30 to about 60;

a first cover layer comprising a highly neutralized ethylene copolymer having a Shore D hardness on the ball of less than about 65; and a second cover layer comprising a thermoset or thermoplastic polyurethane having a Shore D hardness of about 40 to about 55;

wherein the golf ball has a coefficient of restitution in the range of about 0.795 to about 0.815.

2. golf ball of claim 1, wherein the core compression is about 30 to about 40.

3. golf ball of claim 1, wherein the Mooney viscosity of the polybutadiene is about 40 to about 60.

4. golf ball of claim 1, wherein the core comprises metal salts of diacrylates, dimethacrylates, or monomethacrylates.

5. golf ball of claim 1, wherein the first cover layer has a Shore D hardness of about 60 to about 63.

6. golf ball of claim 1, wherein the first cover layer further comprises a material selected from a group consisting of high acid copolymer ionomers, very low modulus acid copolyrner jonomers, low modulus acid copolymers, thermoplastic or thermoset polyurethanes, thermoplastic or thermoset polyetheresters or polyetheramides, thermoplastic or thermoset polyester, dynamically vulcanized elastomers, functionalized styrenebutadiene elastomers, metallocenes, and highly resilient thermoplastic elastomeric compositions.

7. golf ball of claim 1, wherein the core has an outer diameter of about 1.53 inches to about 1.58 inches.

8. golf ball of claim 7, wherein the second cover layer has a Shore D hardness of about 45 to about 48.

9. golf ball of claim 1, wherein the first cover layer has a flexural modulus of less than about 50,000 psi.

10. golf ball of claim 9, wherein the first cover layer has a flexural modulus of about 25,000 psi to about 35,000 psi.

11. golf ball of claim 1, wherein the first or second cover layers have a thickness of about 0.02 inches to about 0.05 inches.

12. golf ball of claim 1, wherein the first cover layer has a flexural modulus of about 2,000 psi to about 8,000 psi.

13. golf ball of claim 1, wherein the salt of a halogenated thiophenol comprises zinc pentachlorothiophenol.

* * * * *